US006101354A

United States Patent [19]

Nakagawa et al.

[11] Patent Number: 6,101,354

[45] **Date of Patent: *Aug. 8, 2000**

[54] ELECTROPHOTOGRAPHIC IMAGE FORMING APPARATUS TO WHICH A PROCESS CARTRIDGE IS DETACHABLY MOUNTABLE AND SUCH A PROCESS CARTRIDGE WHOSE DEVELOPING MEMBER IS SUPPORTED AT A POSITION WHICH DEVIATES FROM A DEVELOPING POSITION

[75] Inventors: Takao Nakagawa, Numazu; Kazushi Watanabe, Mishima; Toshiyuki Karakama, Shizuoka-ken; Atsushi Numagami, Hadano; Katsunori Yokoyama, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/163,345

[22] Filed: Sep. 30, 1998

[30] Foreign Application Priority Data

Oct. 1, 1997 [JP] Japan ..... 9-284677

[51] Int. Cl.[7] ..... G03G 15/01

[52] U.S. Cl. ..... 399/225; 399/222; 399/228; 399/111

[58] Field of Search ..... 399/110, 111, 399/113, 114, 116, 117, 119, 222, 225, 226, 227, 228

[56] References Cited

U.S. PATENT DOCUMENTS

| | | | |
|---|---|---|---|
| 4,794,420 | 12/1988 | Ohashi et al. | 355/3 R |
| 5,089,849 | 2/1992 | Hiraoka | 355/211 |
| 5,095,335 | 3/1992 | Watanabe et al. | 355/210 |
| 5,151,734 | 9/1992 | Tsuda et al. | 355/200 |
| 5,208,634 | 5/1993 | Ikemoto et al. | 355/215 |
| 5,223,893 | 6/1993 | Ikemoto et al. | 355/200 |
| 5,283,616 | 2/1994 | Numagami et al. | 355/245 |
| 5,294,960 | 3/1994 | Nomura et al. | 355/210 |
| 5,331,372 | 7/1994 | Tsuda et al. | 355/200 |
| 5,345,294 | 9/1994 | Nomura et al. | 355/200 |
| 5,404,198 | 4/1995 | Noda et al. | 355/200 |
| 5,455,655 | 10/1995 | Baba et al. | 355/298 |
| 5,463,446 | 10/1995 | Watanabe et al. | 355/200 |
| 5,465,136 | 11/1995 | Watanabe | 355/210 |
| 5,470,635 | 11/1995 | Shirai et al. | 428/131 |
| 5,475,470 | 12/1995 | Sasago et al. | 355/210 |
| 5,488,459 | 1/1996 | Tsuda et al. | 355/211 |
| 5,500,714 | 3/1996 | Yashiro et al. | 355/300 |
| 5,510,878 | 4/1996 | Noda et al. | 355/211 |
| 5,543,898 | 8/1996 | Shishido et al. | 355/210 |
| 5,561,504 | 10/1996 | Watanabe et al. | 355/215 |
| 5,583,613 | 12/1996 | Kobayashi et al. | 355/200 |
| 5,585,895 | 12/1996 | Yashiro et al. | 355/215 |
| 5,602,623 | 2/1997 | Nishibata et al. | 399/111 |
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |

(List continued on next page.)

FOREIGN PATENT DOCUMENTS

| | | |
|---|---|---|
| 0 353 975 | 2/1990 | European Pat. Off. . |
| 0 501 497 | 9/1992 | European Pat. Off. . |
| 0 851 313 | 7/1998 | European Pat. Off. . |

*Primary Examiner*—William Royer
*Assistant Examiner*—Hoang Ngo
*Attorney, Agent, or Firm*—Fitzpatrick, Cella, Harper & Scinto

[57] ABSTRACT

A process cartridge detachably mountable to a main assembly of an electrophotographic image forming apparatus includes an electrophotographic photosensitive member; and developing member for developing a latent image formed on the photosensitive member; The developing member is disposed at a position deviated from a developing position corresponding to a displacement of the developing member resulting from the driving force received from the main assembly of the apparatus when the process cartridge is in the main assembly.

18 Claims, 8 Drawing Sheets

U.S. PATENT DOCUMENTS

| | | | |
|---|---|---|---|
| 5,634,175 | 5/1997 | Michlin et al. | 399/90 |
| 5,640,229 | 6/1997 | Nakahara | 399/119 |
| 5,640,650 | 6/1997 | Watanabe et al. | 399/117 |
| 5,659,847 | 8/1997 | Tsuda et al. | 399/111 |
| 5,669,042 | 9/1997 | Kobayashi et al. | 399/111 |
| 5,689,774 | 11/1997 | Shishido et al. | 399/111 |
| 5,749,027 | 5/1998 | Ikemoto et al. | 399/113 |
| 5,768,658 | 6/1998 | Watanabe et al. | 399/111 |
| 5,768,660 | 6/1998 | Kurihara et al. | 399/111 |
| 5,774,766 | 6/1998 | Karakama et al. | 399/111 |
| 5,790,923 | 8/1998 | Oguma et al. | 399/106 |
| 5,794,101 | 8/1998 | Watanabe et al. | 399/103 |
| 5,809,374 | 9/1998 | Tsuda et al. | 399/111 |
| 5,812,909 | 9/1998 | Oguma et al. | 399/103 |
| 5,828,928 | 10/1998 | Sasago et al. | 399/111 |
| 5,878,304 | 3/1999 | Watanabe et al. | 399/92 |
| 5,878,310 | 3/1999 | Noda et al. | 399/117 |
| 5,884,124 | 3/1999 | Karakama et al. | 399/123 |
| 5,890,036 | 3/1999 | Karakama et al. | 399/119 |

ELECTROPHOTOGRAPHIC IMAGE FORMING APPARATUS TO WHICH A PROCESS CARTRIDGE IS DETACHABLY MOUNTABLE AND SUCH A PROCESS CARTRIDGE WHOSE DEVELOPING MEMBER IS SUPPORTED AT A POSITION WHICH DEVIATES FROM A DEVELOPING POSITION

FIELD OF THE INVENTION AND RELATED ART

The present invention relates to a process cartridge removably installable in the main assembly of an electrophotographic image forming apparatus, and an electrophotographic image forming apparatus in which such a process cartridge can be removably installed.

In this specification, the term electrophotographic image forming apparatus refers to an apparatus which forms an image on a piece of recording medium with the use of an electrophotographic image forming process. As for examples of electrophotographic image forming apparatuses, they include an electrophotographic copying machine, an electrophotographic printer (a laser beam printer, an LED printer, and the like), a facsimile apparatus, a word processor, and the like.

In the past, in an electrophotographic image forming apparatus which employs an electrophotographic image forming process, a process cartridge system has been employed. According to this system, an electrophotographic photosensitive member, and processing means which work with the photosensitive member, are integrated in the form of a cartridge removably installable in the main assembly of an electrophotographic image forming apparatus. This system makes it possible for a user to perform maintenance of the image forming apparatus, greatly improving operational efficiency in image formation. Thus, the process cartridge system has been widely employed in an image forming apparatus.

Some of the process cartridges employ an image developing roller (hereinafter, "development roller") as a means for developing a latent image formed on the peripheral surface of an electrophotographic photosensitive member, with the use of toner. In these process cartridges, a development roller is attached to the development frame portion of a cartridge frame, with a development roller holder and bearings, in such a manner that the development roller is prevented from being misplaced downward a driving force is applied to the development roller.

SUMMARY OF THE INVENTION

The present invention is one of the results of further improvement of the above described prior technology.

An object of the present invention is to provide a process cartridge, the image developing member of which is moved to a predetermined image developing position by the driving force applied to drive the image developing means, and an electrophotographic image forming apparatus in which such a process cartridge can be removably installed.

Another object of the present invention is to provide a process cartridge, the image developing member of which remains precisely at the image developing position while developing an image, and an electrophotographic image forming apparatus in which such a process cartridge can be removably installed.

Another object of the present invention is to provide a process cartridge, the image developing member of which is held in a process cartridge, at a position slightly off from the correct image developing position, in consideration of the amount of distance by which the image developing member is displaced as it receives a driving force from the main assembly of an image forming apparatus while the process cartridge is in the main assembly of an image forming apparatus, and an image forming apparatus in which such a process cartridge is removably installable.

Another object of the present invention is to provide a process cartridge, the image developing member of which is displaced to the image developing correct position as a driving force is applied to the image developing member, and an image forming apparatus in which such a process cartridge is removably installable.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Figure 1:
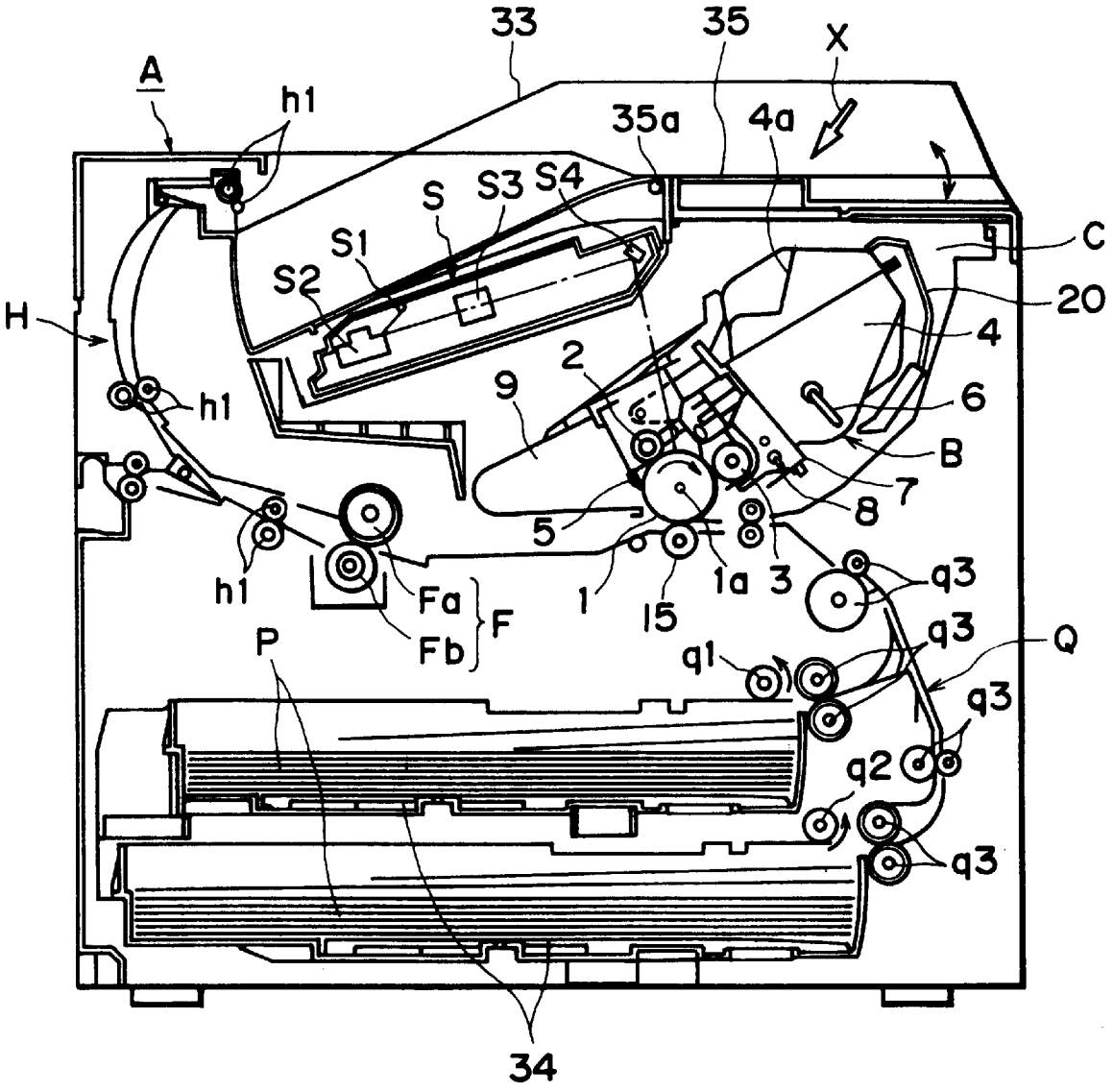
FIG. 1 is a vertical section of the electrophotographic image forming apparatus in the first embodiment of the present invention, in the main assembly of which the process cartridge in the first embodiment of the present invention has been installed.

I. General Structure of Electrophotographic Photosensitive Image Forming Apparatus FIG. 1 is a vertical section of the electrophotographic image forming apparatus, in this embodiment of the present invention, in which the process cartridge in this embodiment has been installed. Hereinafter, the structure of the image forming apparatus will be described with reference to FIG. 1. The electrophotographic image forming apparatus in this embodiment is a laser beam printer.

First, the method for installing or removing a process cartridge B will be described. First, referring to FIG. 1, the cover 35 located at the top of the electrophotographic image forming apparatus main assembly A (hereinafter, "apparatus main assembly") is opened. Then, the process cartridge B is inserted into the process cartridge space C in the direction indicated by an arrow mark X perpendicular to the axial line la (longitudinal direction of the photosensitive drum 1) of the electrophotographic photosensitive drum 1 (hereinafter, "photosensitive drum"), along the unillustrated cartridge installation guides located one for one at each end of the process cartridge space C (each end in terms of the longitudinal direction of the photosensitive drum 1), whereby the process cartridge B is removably set in the process cartridge space C. In the drawing, reference numeral 4*a* designates a recessed portion of the process cartridge B, which constitutes the handhold portion of the process cartridge B, and a reference numeral 35*a* designates a hinge, which constitutes the rotational center, or axis, of the cover 35 of the apparatus main assembly A.

The image copying process (electrophotographic image forming process) of the above described electrophotographic image forming apparatus is as follows.

First, the image signals created in the apparatus main assembly A are converted into a laser beam by a scanning unit S. The photosensitive drum 1 is uniformly charged, on its peripheral surface, by a charge roller 2 as the charging means (charging member) of the process cartridge B. The laser beam is projected onto the uniformly charged peripheral surface of the rotating photosensitive drum 1, whereby an electrostatic latent image is formed.

Meanwhile, in the process cartridge B, toner (image developing agent, i.e., developer) stirred by a toner stirring member 6, as a member for stirring the toner in the toner container 4, is delivered to an image developing station frame 7 (hereinafter, "development frame") in which the toner is further loosened. Thereafter, the toner electrically transfers onto the peripheral surface of the photosensitive drum 1, in a manner to reflect the pattern of the latent image. As a result, a toner image is formed on the peripheral surface of the photosensitive drum 1.

A piece of recording medium P (for example, a sheet of recording paper) is selectively sent out of one of two recording medium feeding trays 34 stacked in the bottom portion of the apparatus main assembly A, by a pickup roller q1 or q2 of the sheet feeding mechanism Q. Then, the recording medium P is delivered to the photosensitive drum 1 by a plurality of conveyer rollers q3. As voltage is applied to the transfer roller 15, the toner image, having been formed on the photosensitive drum 1, is transferred onto the recording medium P. The toner particles which remain on the photosensitive drum 1 without being transferred onto the recording medium P during this image transferring process are scraped into a toner container 9 by a cleaning blade 5 as a cleaning means (cleaning member).

After receiving the toner image, the recording medium P is passed through a fixing apparatus F, which comprises an image fixing roller Fa, which contains a heater, and a driving roller Fb. In the fixing apparatus F, heat and pressure are applied to the recording medium P, and the toner image on the recording medium P. As a result, the toner image is permanently fixed to the recording medium P. Then, the recording medium P is discharged into a delivery tray 33, by a plurality of rollers h1 of a sheet discharging mechanism H.

Again referring to FIG. 1, reference numeral S1 designates a laser beam source; S2 denotes a polygon mirror; S3 denotes a lens; and S4 denotes designates a reflecting mirror. These components are some of the components which constitute the scanning unit S.

Figure 2:
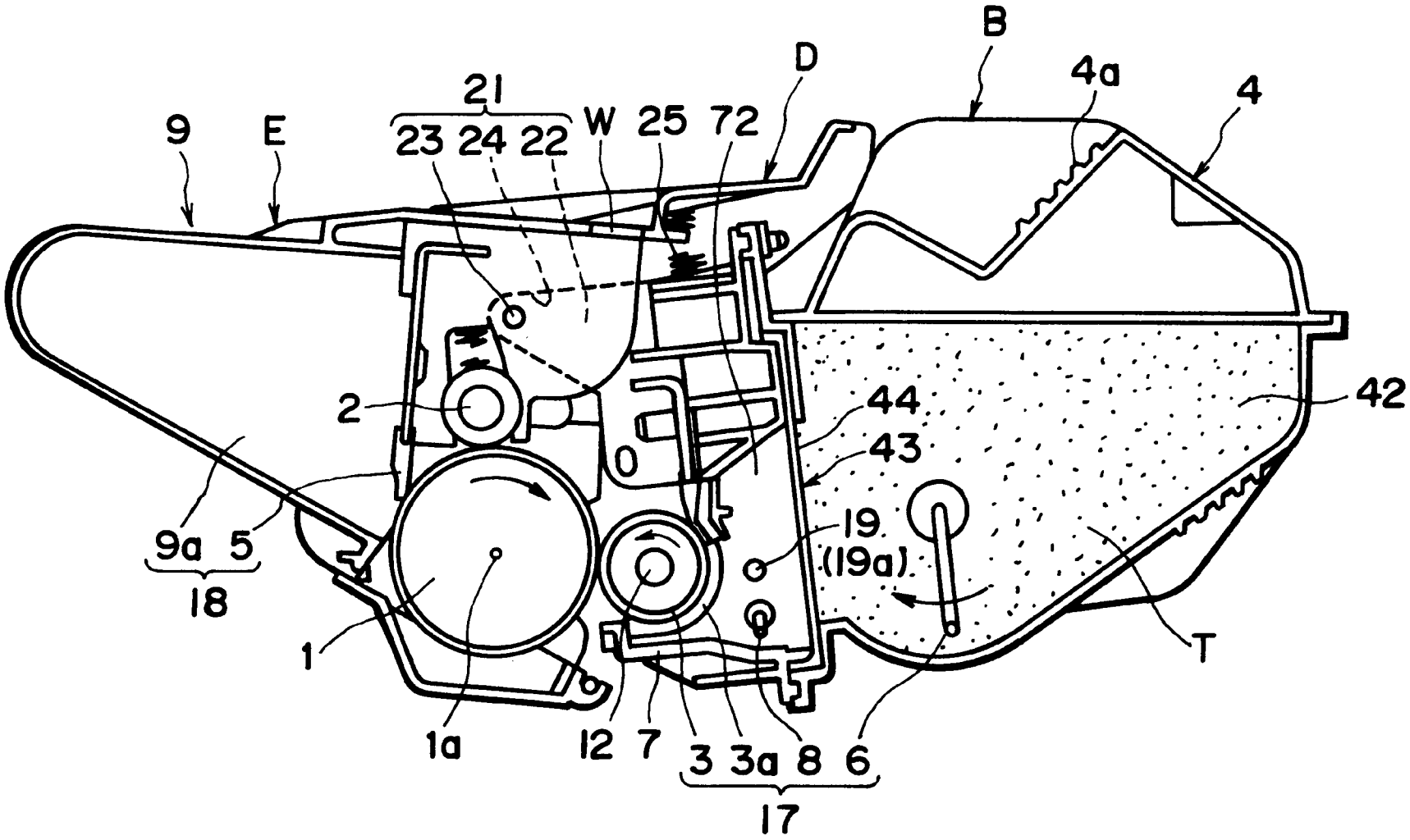
FIG. 2 is a cross section of the process cartridge in the first embodiment of the present invention.

II. Structure of Process Cartridge Housing, and Internal Structure of Process Cartridge FIG. 2 is a section of the process cartridge in this embodiment. Hereafter, the structure of the process cartridge housing, and the internal structure of the process cartridge will be described with reference to FIG. 2.

The process cartridge B is constituted of the toner container section 4, the development frame section 7, and a waste toner container section 9. The toner containing portion 4 is integrated with the developing frame section 7, and the toner containing section 9 is rotatively connected to the integral combination of the toner containing portion 4 and the developing frame section 7. These three components constitute the housing of the process cartridge B, i.e., the cartridge frame. The process cartridge B in this embodiment is produced by integrally placing the photosensitive drum 1, the charge roller 2, an image developing means 17, and a cleaning means 18, in the housing. The developing means 17 and the cleaning means 18 will be described later.

The toner containing section 4 and the development frame 7 are integrally welded to form a development unit D.

The toner containing portion 4 of the development unit D has a toner holding portion 42 for holding toner T. The toner holding portion 42 has a recessed portion 4*a* and a toner delivery opening 43. The recessed portion 4*a* is a handhold, and the toner delivery opening 43 is the hole through which toner T is delivered into the toner developing device 72 (development chamber). The toner delivery opening 43 is covered with a sealing member 44, which is welded to the periphery of the toner delivery opening 43 to seal the toner containing portion 42. The sealing member 44 prevents the toner T held in the toner holding portion 42, from leaking out before the process cartridge B begins to be used. The sealing member 44 is pulled out immediately before the usage of the process cartridge B begins, so that the toner T held in the toner holding portion 42 can be delivered to the development roller 3.

In the development frame 7 of the development unit D, the image developing means 17 is supported. The image developing means 17 is constituted by the T stirring member 6, the development roller 3, the development blade 3*a*, and D stirring member 8. The T stirring member 6 is in the toner containing portion 4, and the others are in the development frame 7. As the T stirring member 6 of the image developing means 17 is rotated, the toner T in the developing device 72 is delivered to the development roller 3. Then, as the development roller 3 is rotated, a layer of toner is formed on the peripheral surface of the development roller 3 by the development blade 3*a*. The toner particles which form the toner layer are electrically transferred onto the latent image formed on the peripheral surface of the photosensitive drum 1 to develop the latent image. As the D stirring member 8 is rotated in synchronism with the T stirring member 6 and the development roller 3, the toner T in the developing device 72 is stirred. The structure of the image developing means 17 is not limited to the one described in this embodiment; it is optional.

Within the developing device 72 of the aforementioned development frame 7, a toner amount detecting means 19 is disposed. The toner amount detecting means 19 has a metallic antenna line 19*a*, which is stretched in parallel to the development roller 3, across the toner delivery passage through which the toner is delivered from the toner holding portion 42 to the development roller 3 within the image developing device 72. The toner amount detecting means 19 determines the remaining amount of the toner by detecting the amount of the electrostatic capacity between the antenna line 19*a* and the development roller 3 when voltage is applied to the development roller 3. More specifically, the remaining amount of the toner is detected based on the phenomenon that when there is toner between the antenna line 19*a* and the development roller 3, the electrostatic capacity between the two becomes smaller, whereas when there is no toner between the antenna line 19*a* and the development roller 3, the electrostatic capacity between the two becomes higher. With this arrangement, it is determined whether or not there remains toner in the process cartridge B. This process of determining the remaining amount of the toner is carried out for each electrophotographic image formation cycle.

The aforementioned toner container portion 9 contains the photosensitive drum 1, the charge roller 2, and the cleaning means 18 constituted of the cleaning blade 5 and the toner holding portion 9*a*. It also has a rotatively movable drum shutter 20 (FIG. 1), which is attached to the outward side of the waste toner container portion 9 to protect the photosensitive drum 1 by covering the photosensitive drum 1 when the process cartridge B is outside the apparatus main assembly A. Further, the toner containing portion 9 has an opening W through which the laser beam from the scanning unit S is projected into the process cartridge B. This toner containing portion 9 houses a cleaning unit E.

The cleaning unit E and the aforementioned development unit D are connected with a connecting member 21, in such a manner that they are rotatable about each other. They constitute the process cartridge B.

Referring to FIG. 2, the tip of the arm portion 22 formed at each longitudinal (i.e., the direction of the axial line 1*a* of development roller 3) end of the development frame 7 of the development unit D is provided with a rotational axis 23, whereas each longitudinal end of the toner containing portion 9 is provided with a recess 24. Into this recess 24, the rotational axis 23 is engaged to properly position the rotational axis 23. Then, the connecting member 21 is attached to the toner containing portion 9, whereby the development unit D and cleaning unit E are connected in such a manner that they can be rotated relative to each other about the rotational axis 23. After two units are connected, the development frame D2 is pressed downward by the compression spring 25 attached to the connecting member 21, which assures that the development roller 3 is pressed upon the photosensitive drum 1. More specifically, a spacer roller 3*b*, the diameter of which is larger than that of the development roller 3, is attached to each longitudinal end of the development roller 3, and this spacer roller 3*b* is pressed upon the photosensitive drum 1, maintaining a predetermined distance between the peripheral surfaces of the photosensitive drum 1 and the development roller 3. With the above described arrangement, the development unit D and the cleaning unit E are rotatable relative to each other, about the axis 23, and further, the positional relationship between the peripheral surfaces of the photosensitive drum 1 and the development roller 3 can be maintained by the elastic force of the compression spring 25.

III. Driving of Process Cartridge

In the housing of the process cartridge B structured as described above, the photosensitive drum 1, the T stirring member 6 of the developing means 17, the development roller 3, and the D stirring member 8, are connected with a gear mechanism (unillustrated) so that they synchronously move. As the process cartridge B is installed in the process cartridge space C of the apparatus main assembly A, the follower gear (unillustrated) attached to the axis (unillustrated) of the photosensitive drum 1 meshes with the driving gear (unillustrated) of the apparatus main assembly A, which is rotatively driven by the main motor in the apparatus main assembly A. With this arrangement, the gear train in a development roller holder 10, which is engaged with the follower gear of the photosensitive drum 1, is rotatively driven by the follower gear, whereby the photosensitive drum 1, the T stirring member 6, the development roller 3, and the D stirring member 8 are rotated. The development roller holder 10 will be described later.

The process cartridge B comprises a ground contact point for the photosensitive drum 1, a charge bias contact point for the charge roller 2, the development bias contact point for the development roller 3, and the toner amount detecting contact point connected to the antenna line 19*a* of the toner amount detecting means 19, which are located at predetermined positions on the external surface of the housing (none of these contact points are illustrated in the drawing). As the process cartridge B is installed in the process cartridge space C provided in the apparatus main assembly A, these electrical contact points are electrically connected to the corresponding electrical contact points (unillustrated) provided in the apparatus main assembly A.

IV. Development Roller Supporting Structure

Figure 3:
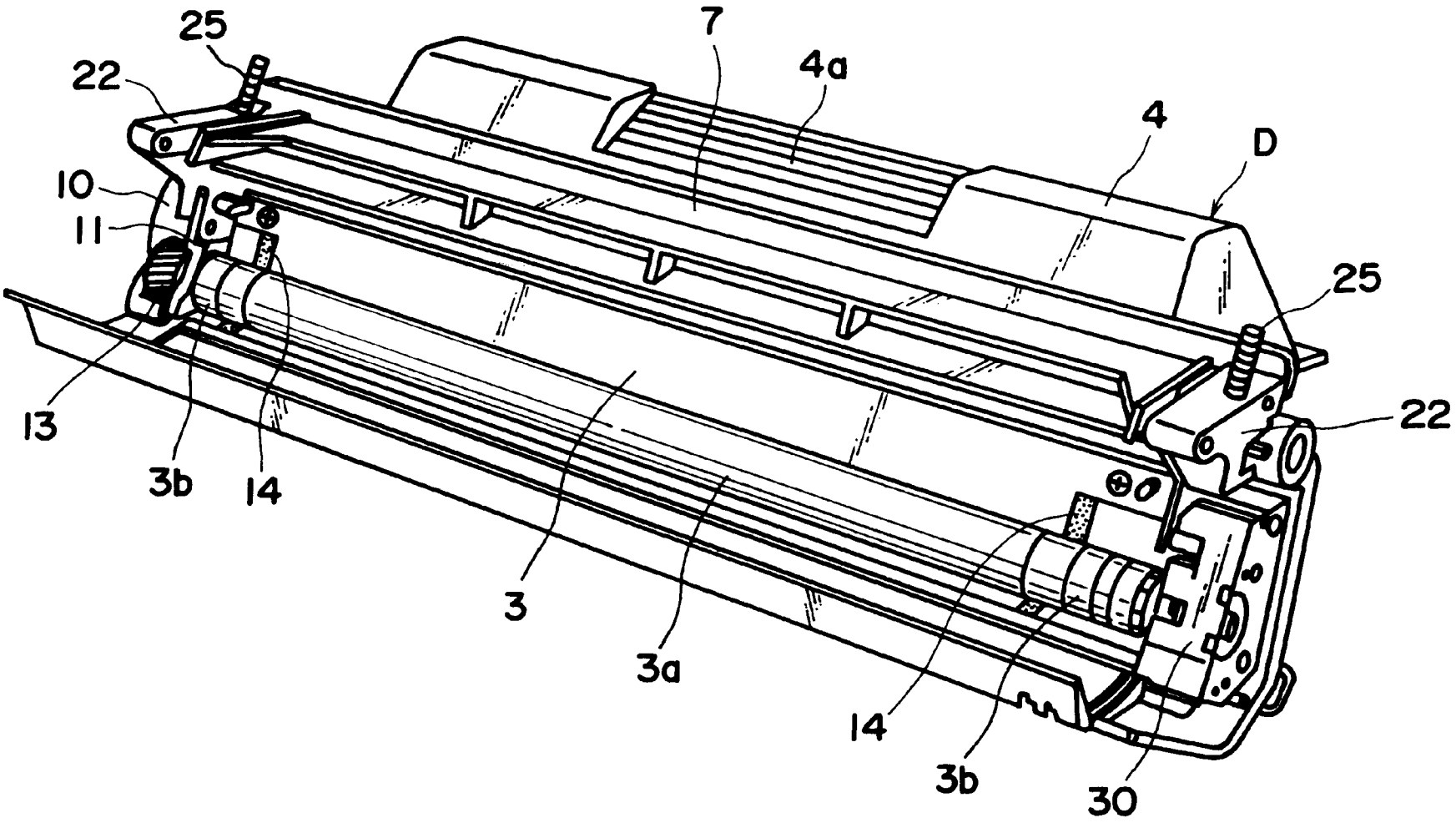
FIG. 3 is a perspective view of the development unit of the process cartridge in the first embodiment of the present invention.

Referring to FIG. 3, the development roller 3 is supported by the development frame 7, at both of its longitudinal ends. More specifically, the driven side (left side in drawing) through which the driving force from the main motor of the apparatus main assembly A is transmitted is supported by the development roller holder 10 and a development sleeve bearing 11, and the side (right side in drawing) opposite to the driven side is supported by the bearing box and the development frame 7. In this embodiment, the development roller holder 10 and the bearing 11 constitute the development roller holding means.

Figure 4:
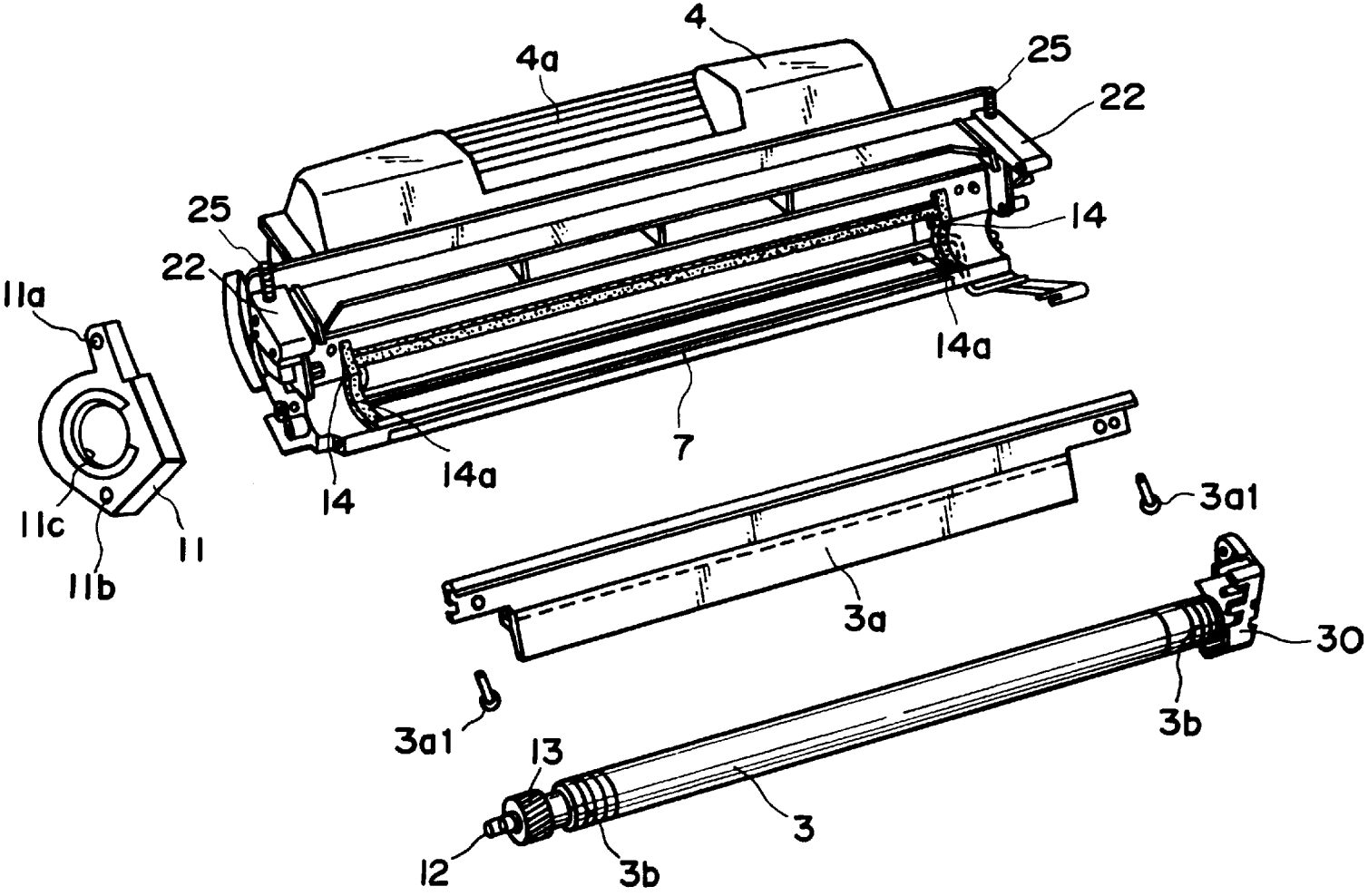
FIG. 4 is a perspective view of the partially disassembled development unit illustrated in FIG. 3.
Figure 5:
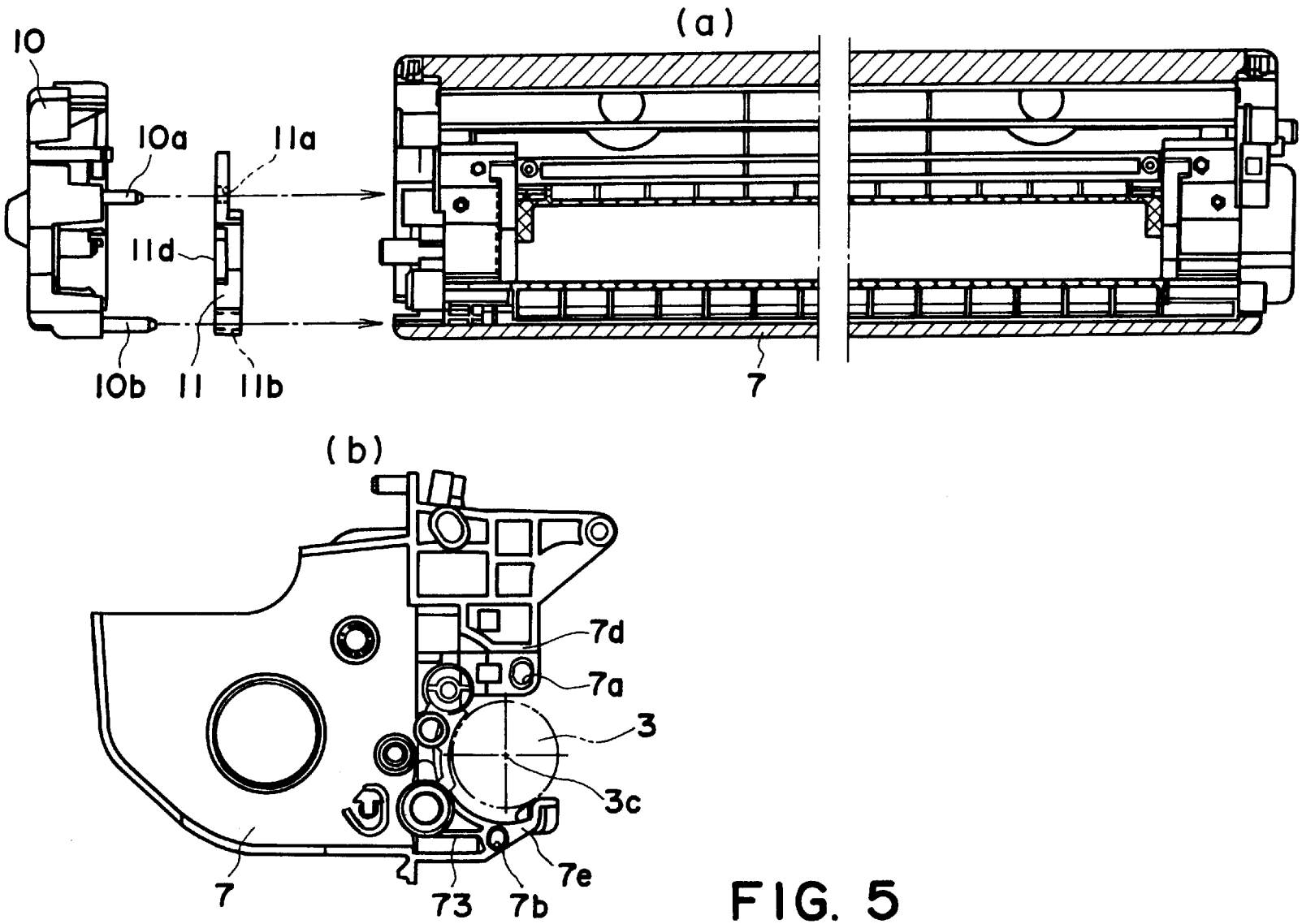
FIG. 5, (a) is a front view of the partially disassembled development unit of the process cartridge illustrated in FIG. 3, and depicts the development unit frame, the sleeve bearing, and the image developing member holder, and FIG. 5, (b) is a side view of the development unit, on the side from which the image developing member is driven.

Hereinafter, the structure which supports the development roller 3 will be described with reference to FIGS. 4 and 5. FIG. 4 is an exploded perspective view of the development frame 7 of the development unit D. FIG. 5, (a) is an exploded front view of the bearing 11 and the development roller holder 10, and FIG. 5, (b) is a side view of the development frame 7, on the driven side.

The development roller 3 is in the form of a hollow cylinder, and contains a magnetic roller 12 (FIGS. 2 and 4). This magnetic roller 12 plays a role in holding the toner loosened by the D stirring member 8, on the peripheral surface of the development roller 3. The magnetic roller 12 protrudes from both longitudinal ends of the development roller 3, and is nonrotatively supported by the development roller holder 10. Both longitudinal ends of the development roller 3 are fitted with the spacer roller 3*b* having an external diameter larger than that of the development roller 3. The longitudinal end of the development roller 3, on the side of the bearing 11, is fitted with a sleeve gear 13, which engages with one of the gears of the internal gear train of the development roller holder 10 (FIG. 4). The internal gear train of the development roller holder 10 will be described later.

Referring to FIG. 5, (a), the development roller holder 10 is in the form of a box which is open on the side of development frame 7. In the development roller holder 10, the gear train (unillustrated) which drives the development roller 3, the T stirring member 6, the D stirring member 8, and the like, are disposed. The development roller holder 10 is provided with two shafts, i.e., the top and bottom shafts 10*a* and 10*b*, which extend in the direction of the development frame 7.

The bearing 11 is given such a shape that allows the bearing 11 to be fitted into the longitudinal end of the development frame 7, and is provided with top and bottom holes 11*a* and 11*b*, through which the shafts 10*a* and 10*b* of the development roller holder 10 are put, respectively, and a hole 11d through which the development roller 3 is put (FIG. 4 and FIG. 5, (a)). The bottom hole 11*b* is given a truly circular shape to support the development roller holder 10, whereas the top hole 11*a* is given a cross section slightly elongated toward the axial line 3*c* of the development roller 3 to regulate the rotation of the development roller holder 10 about the aforementioned bottom hole 11*b*.

As described before, the supporting portion 73 of the development frame 7, which supports the development roller 3, is given an approximate shape of a letter C, so that the recording medium can be passed through it, and also that the electrical contact points of the apparatus main assembly A and the process cartridge B can be desirably disposed (FIG. 5, (b)).

The supporting piece 7*d*, on the top side, of the supporting portion 73 of the development frame 7, and the jaw-like portion, on the bottom side, of the supporting portion 73 of the development frame 7, are provided with holes 7*a* and 7*b*, respectively, into which the shafts 10*a* and 10*b* of the development roller holder 10 are inserted. The hole 7*b* is given a truly round cross section, and its main role is to support the development roller holder 10 and the development sleeve bearing 11. The hole 7*a* is given a cross section slightly elongated toward the axial line 3*c* of the development roller 3 to regulate the rotation of the development sleeve bearing 11 and the development roller holder 10 about the hole 7*b*.

The development frame 7 is provided with magnetic sealing members 14, i.e., means for preventing developer from leaking out, which are attached to the development frame 7, at the positions corresponding to the longitudinal ends of the development sleeve 3, one for one (FIG. 4). The magnetic sealing members 14 do not come in contact with the development sleeve 3, but their magnetic force prevents toner from leaking out of the development frame 7. These magnetic sealing members 14 have a downwardly curved portion 14*a*, the cross section of which is approximately semicircular (FIG. 4). The inward surface of this portion 14 faces the peripheral surface of the development sleeve 3.

With the provision of the above described components with the above described structure, the bearing box 30, which is located on the side opposite to the driven side, is fixed to the development frame 7 with the use of small screws, as shown in FIG. 4 and FIG. 5, (a). The driven side of the development roller 3 is put through the through hole 11*c* of the bearing 11. In the holes 11*a* and 11*b* of the bearing 11, and also in the holes 7*a* and 7*b* of the development frame 7, the shafts 10*a* and 10*b* of the development roller holder 10 are fitted. Thus, the development roller 3 is rotatively supported by the development frame 7. In FIG. 4, reference numeral 3*a* designates a development blade, which is fixed to the development frame 7 with a small screw 3*a*1.

V. Structure for Preventing Downward Misplacement of Development Roller

As described above, there is a path, through which the recording medium P is put, next to the jaw-like bottom portion 7*e* of the supporting portion 73 of the development frame 7. Since the electrical contact points of the apparatus main assembly A and the process cartridge B must be properly positioned, it is sometimes difficult to provide a large enough space for reinforcing the jaw-like bottom portion 7*e*; as the sizes of the apparatus main assembly A and/or the process cartridge B are reduced, or the walls themselves of the development frame 7 are rendered thin, the rigidity of the jaw-like bottom portion 7*e* is sometimes reduced.

Figure 8:
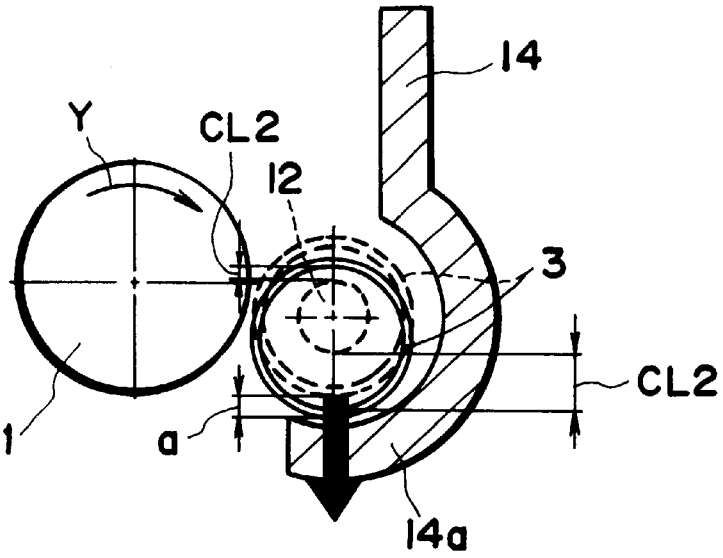
FIG. 8 is a schematic drawing which depicts the downward misplacement of the development roller from the correct position, which occurs as the development roller is driven.

In such a case, that is, if the jaw-like bottom portion 7*e* of the development frame 7 is weak in terms of flexural rigidity, the development sleeve supporting bearing 11 is displaced downward (FIG. 8), i.e., in the direction in which the driving force is applied, when driving force is transmitted to the development roller 3 through the gear train in the development roller holder 10; the development roller 3 sometimes is displaced downward by a gap a from the normal (correct) position indicated by a broken line, to a position indicated by a solid line, as shown in FIG. 8. If such displacement of the development roller 3 occurs, it is possible that the development roller 3 comes in contact with the magnetic sealing member 14 (downwardly curved portion 4*a*), and/or the clearance CL2 between the development roller 3 and the magnetic roller 12 becomes nonuniform. In FIG. 8, reference numeral 14 designates the magnetic sealing member attached to the development frame 7.

Figure 6:
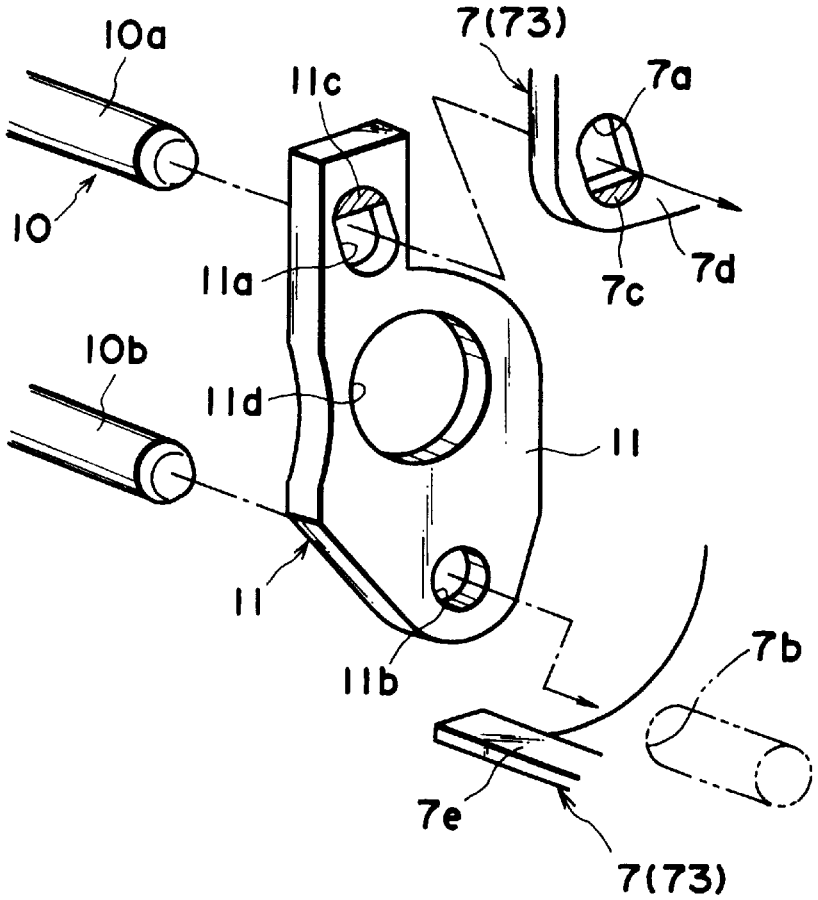
FIG. 6 is a perspective view of the structural arrangement in the process cartridge in the first embodiment of the present invention, for preventing the development roller from being misplaced downward from the correct position in the cartridge.

Thus, in this embodiment, in order to prevent the development roller 3 from being downwardly misplaced as the driving force is transmitted to the gear train within the development roller holder 10, from the follower gear of the photosensitive drum 1, pads 7*c* and 11*c* are placed in the rotation regulating hole 7*a* (elongated hole) of the development frame 7, and the rotation regulating hole 11*a* (elongated hole) of the development sleeve bearing 11, as shown in FIG. 6 (at the bottom of the hole 7*a* of the development frame 7, and at the top of the hole 11*a* of the bearing 11). Then, the shafts 10*a* and 10*b* of the development roller holder 10 are put through the holes 11*a* and 11*b* of the bearing 11, and the holes 7*a* and 7*b* of the development frame 7. With this arrangement, the position of the bearing 11 relative to the development frame 7 is above the conventional (correct) position of the bearing 11.

Figure 7:
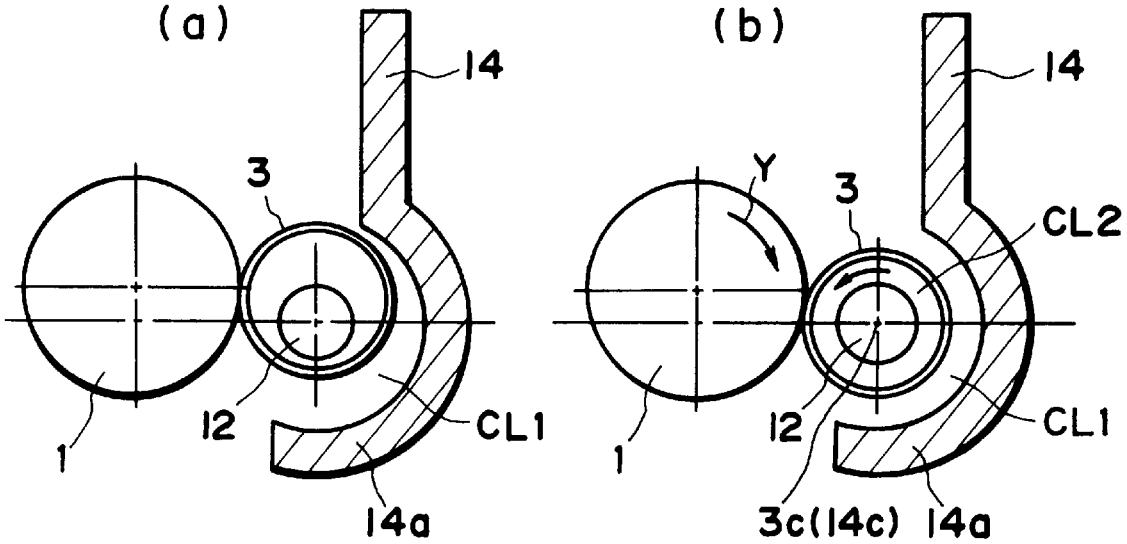
FIG. 7 is a schematic drawing which depicts the positional relationship among the electrophotographic photosensitive member, the development roller, the magnetic roller, and the magnetic sealing member, in the process cartridge in the first embodiment depicted in FIG. 6, in which a structural arrangement has been made to prevent the development roller from being misplaced downward from the correct position, (a) showing their positional relationship when the process cartridge is out of an image forming apparatus, and (b) showing their positional relationship during the period in which the development roller has been displaced downward as it is driven.

That is, the development sleeve bearing 11 is attached to the development frame 7 in such a manner that the clearance CL1 between the development roller 3 and the magnetic sealing member 14 (downwardly curved portion 14*a*) becomes narrower on the upstream side (top side) than on the downstream side (bottom side), in terms of the displacement direction (downward displacement) of the development roller 3 which occurs as driving force is transmitted to the development roller 3, as shown in FIG. 7, (a); the development sleeve bearing 11 is attached to the development frame 7 in anticipation of the downward displacement of the development roller 3.

In other words, the development roller 3 is attached to the development frame 7 in such a manner that a driving force is transmitted to the development roller 3, the development roller 3 and the magnetic sealing member 14 become virtually concentric (FIG. 7, (b)); the bearing 11 is attached to the development frame 7 in such a manner that the position of the development roller 3 becomes slightly off from the conventional position, in the direction opposite to the direction in which the development roller 3 is displaced as the driving force is transmitted.

The height of the pads 7*c* and 11*c* (in the displacement direction the development roller 3) is determined in accordance with the amount of the displacement of the development roller 3. In this embodiment, the amount of the clearance CL2 necessary between the development roller 3 and the magnetic roller 12 while the driving force is transmitted from the photosensitive drum 1 to the development roller 3 is 0.2–0.3 mm, and the amount of the clearance CL1 necessary between the peripheral surface of the development roller 3 and the magnetic sealing member 14 (curved portion 14*a*) while the driving force is transmitted to the development roller 3 from the photosensitive drum 1 is 0.2–0.6 mm. In consideration of these amounts of the necessary clearances CL1 and CL2, the heights of the pads 7*c* and 11*c* are set so that the position of the development roller 3 becomes 0–0.2 mm above the conventional position after the shaft 10*a* is put through.

With the above described arrangement, as the photosensitive drum 1 is rotated in the direction indicated by an arrow mark Y, the driving force is applied to the development roller 3 through the gear train of the development roller holder 10, which in turn causes flexural force to be applied to the jaw-like bottom portion 7*e* of the development frame 7. As a result, the bearing 11 is displaced downward, that is, in the direction in which the driving force is applied, to the correct position for the development roller 3, as shown in FIG. 7, (b). In other words, as the photosensitive drum 1 is rotated, the development roller 3 is correctly positioned; the development roller 3 is displaced to the correct position, at which the position of the axial line 3*c* of the development roller 3 virtually coincides with the position of the center 14*c* of the curved portion 14*a* of the magnetic sealing member 14.

As is evident from the above description, according to this embodiment, as the photosensitive drum 1 is driven, and driving force is transmitted to the development roller 3, the development roller 3 is displaced downward to the correct position. Therefore, the clearance CL1 between the peripheral surfaces of the development roller 3 and the magnetic sealing member 14 (curved portion 14*a*) is rendered uniform, being about several hundreds microns.

Thus, according to this embodiment, it is possible to avoid the problems which occur as the development roller 3 comes in contact with the peripheral surface of the magnetic sealing member 14 attached to the development frame 7; for example, the problem that the particles created by the shaving of the magnetic sealing member 14 and the development roller 3 mix into the toner, interfering with the image developing process, or the problem that after mixing into the toner, the particles composed of the shaving from the magnetic sealing member 14 and the development roller 3 interfere with the image transferring process and the image fixing process, which come after the image developing process.

Further, according to this embodiment, the development roller 3 is correctly positioned, and therefore, the clearance CL2 between the development roller 3 and the magnetic roller 12 is kept uniform during image formation.

Thus, it is possible to solve the problems that occur as the clearance CL2 between the development roller 3 and the magnetic roller 12 becomes uneven by the downward misplacement of the development roller 3 (FIG. 8); for example, the problem that the development roller 3 and the magnetic roller 12 rub against each other, or the problem that the force which holds the toner on the peripheral surface of the development roller 3 is reduced. In other words, the factors that invite decrease in image developing performance can be eliminated.

FIG. 8 depicts the mechanism by which the clearance CL2 between the development roller 3 and the magnetic roller 12 becomes uneven by the downward misplacement of the development roller 3; as the development roller 3 is misplaced downward, the clearance CL2 decreases around the top portion of the magnetic roller 12, and increases around the bottom portion of the magnetic roller 12.

Embodiment 2

The structures of the various portions of the process cartridge B and the apparatus main assembly A, in this embodiment, are the same as those in the first embodiment. Therefore, only the structure for preventing the downward misplacement of the development roller 3, in this embodiment, which is different from that in the first embodiment, will be described.

I. Structure for Preventing Downward Misplacement of Development Roller

In this embodiment, in order to prevent the downward misplacement of the development roller 3 which occurs as driving a force is transmitted to the gear train of the development roller holder 10 from the follower gear of the photosensitive drum 1, the development roller holder supporting role is mainly assigned to the top portion of the supporting portion of the development frame 7, and the rotation of the development roller holder 10 is regulated by the bottom side of the development frame 7.

Figure 9:
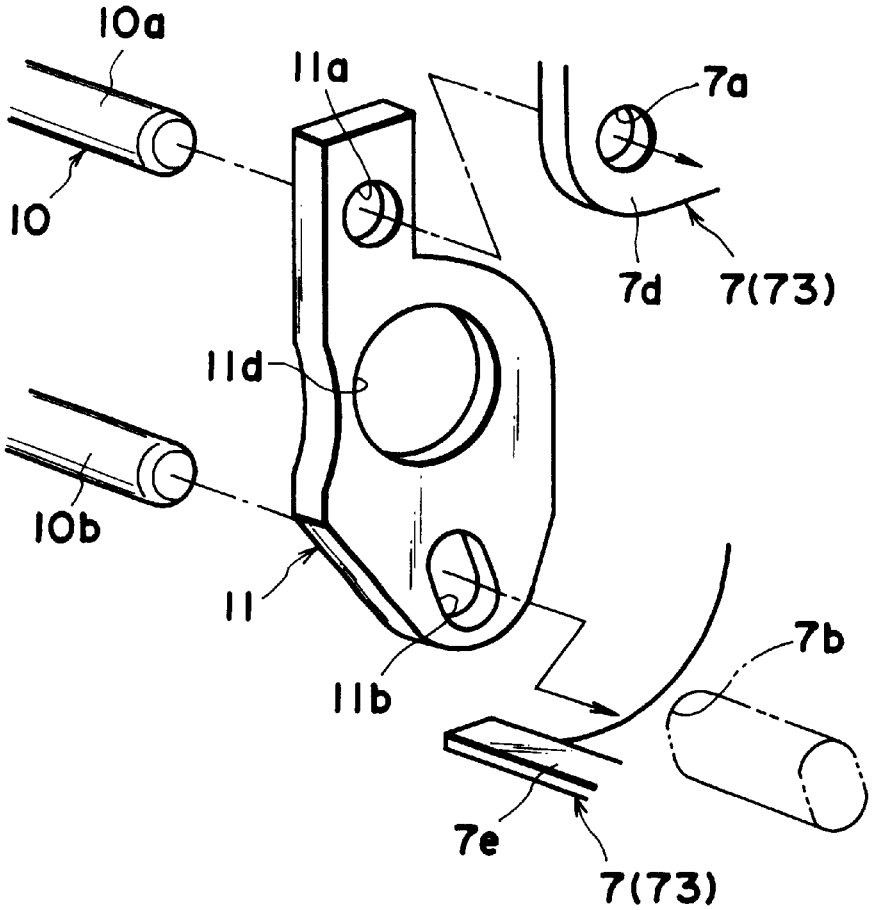
FIG. 9 is an exploded perspective view of the structure, in the process cartridge in the second embodiment of the present invention, which prevents the development roller from being misplaced downward from the correct position.

More specifically, referring to FIG. 9, the top portion of the bearing 11, and the supporting piece 7*d* of the supporting portion 73 of the development frame 7, are provided with truly circular holes 11*a* and 7*a*, respectively, and the bearing 11 is supported by the supporting piece 7*d*, on the top side, of the development frame 7, by putting the top shaft 10*a* of the development roller holder 10 through the holes 11*a* and 7*a*. The bottom portion of the bearing 11, and the jaw-like bottom portion 7*e* of the supporting portion 73 of the development frame 7, are provided with elongated holes 11*b* and 7*b*, respectively, and the bearing 11 is supported by the jaw-like bottom portion 73 of the development frame 7, by putting the bottom shaft 10*b* of the development roller holder 10 through the holes 11*b* and 7*b*.

With the above arrangement, it is possible to prevent the downward misplacement of the development roller 3 which occurs as a driving force is applied to the development roller 3, because the supporting piece 7*d* of the development frame 7 is stronger than the bottom jaw-like portion 7*e* (if the round hole is in the bottom jaw-like portion 7*e*, the flexural force is applied to the bottom jaw-like portion 73, and if the round hole is in the top supporting piece 7*d*, the tensile force is applied to the top supporting piece 7*d*).

Therefore, also in this embodiment, the clearance CL1 between the peripheral surfaces of the development roller 3 and the magnetic sealing member 14 can be rendered uniform, being about several hundred microns as it was in the first embodiment, preventing the problems which occur as the development roller 3 comes in contact with the peripheral surface of the magnetic sealing member 14.

Further, the clearance CL2 between the development roller 3 and the magnetic roller 12 can be kept uniform during image formation.

Embodiment 3

The structures of the various portions of the process cartridge B and the apparatus main assembly A, in this embodiment, are the same as those in the first embodiment. Therefore, only the structure for preventing the downward misplacement of the development roller 3, in this embodiment, which is different from that in the first embodiment, will be described.

I. Structure for Preventing Downward Misplacement of Development Roller

In this embodiment, in order to prevent the downward misplacement of the development roller 3 which occurs as a driving force is transmitted to the gear train of the development roller holder 10 from the follower gear of the photosensitive drum 1, the development roller holder supporting role is mainly assigned to the top side of the development frame 7, and the bearing rotation regulating role is assigned to the bottom portion of the development frame 7, as they are in the second embodiment.

Figure 10:
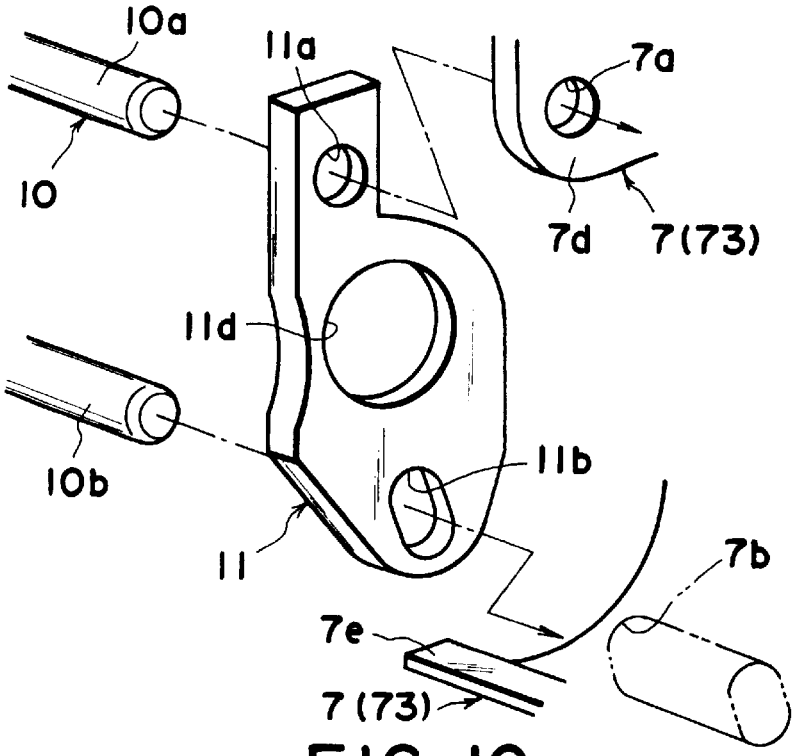
FIG. 10 is an exploded perspective view of the structure, in the process cartridge in the third embodiment of the present invention, which prevents the development roller from being misplaced downward from the correct position.

More specifically, referring to FIG. 10, the top shaft 10*a* of the development roller holder 10 is rendered thicker than the bottom shaft 10*b*. The top portion of the bearing 11, and the top supporting piece 7*d* of the supporting portion 73 of the development frame 7, are provided with truly round holes 11*a* and 7*a*, respectively. The top shaft 10*a* of the development roller holder 10 is put through these holes 11*a* and 7*a*, supporting the development roller holder 10 by the top supporting piece 7*d* of the development frame 7. The bottom portion of the bearing 11, and the bottom jaw-like portion 7*e* of the supporting portion 73 of the development frame 7, are provided with elongated holes 11*b* and 7*b*, respectively, and the bottom shaft 10*b* of the development roller holder 10 is put through the elongated holes 11*b* and 7*b*, supporting the bearing 11 by the bottom jaw-like portion 7*e* of the development frame 7.

In other words, according to this embodiment, the main portion which supports the development roller holder 10 is strengthened by increasing the diameter of the shaft 10*a*, and therefore, the downward misplacement of the development roller 3, which occurs as driving force is applied to the development roller 3, can be prevented.

Therefore, the clearance CL1 between the peripheral surfaces of the development roller 3 and the magnetic sealing member 14 is kept uniform, being approximately several hundreds microns during image formation, as stated in the description of the first embodiment.

Also, the clearance CL2 between the development roller 3 and the magnetic roller 12 can be kept uniform.

Embodiment 4

The structures of the various portions of the process cartridge B and the apparatus main assembly A, in this embodiment, are the same as those in the first embodiment. Therefore, only the structure for preventing the downward misplacement of the development roller 3, in this embodiment, which is different from that in the first embodiment, will be described.

I. Structure for Preventing Downward Misplacement of Development Roller

In this embodiment, in order to prevent the downward misplacement of the development roller 3 which occurs as a driving force is transmitted to the gear train of the development roller holder 10 from the follower gear of the photosensitive drum 1, the development roller supporting role is mainly assigned to the top side of the development frame 7, and the development roller rotation regulating role is assigned to the bottom portion of the development frame 7, as they are in the second embodiment.

Figure 11:
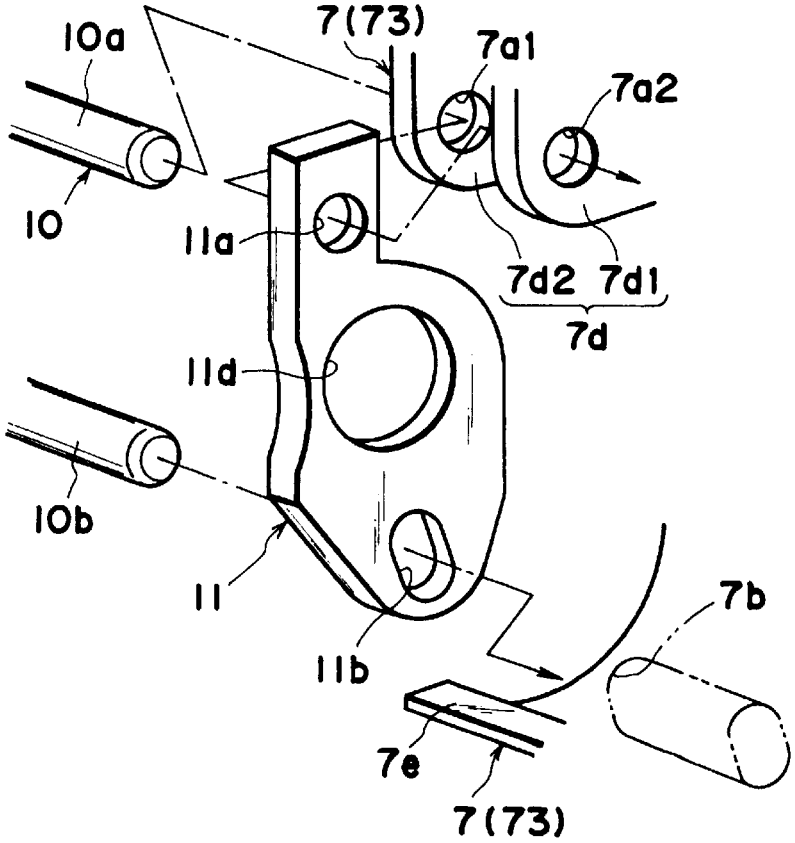
FIG. 11 is an exploded perspective view of the structure, in the process cartridge in the fourth embodiment of the present invention, which prevents the development roller from being misplaced downward from the correct position.

More specifically, referring to FIG. 11, the top side of supporting portion 73 of the development frame 7 is constituted of a pair by the supporting pieces 7*d*1 and 7*d*2, which are disposed side by side in parallel. This pair of supporting pieces 7*d*1 and 7*d*2, and the top portion of the bearing 11, are provided with truly round holes 7*a*1, 7*a*2, and 11*a*, respectively, and the top shaft 10*a* of the development roller holder 10 is put through these holes 7*a*1, 7*a*2, and 11*a*, supporting the development roller holder 10 by the pair of supporting pieces 7*d*1 and 7*d*2. The bottom portion of the bearing 11, and the jaw-like bottom portion 7*d* of the supporting portion 73 of the development frame 7, are provided with elongated holes 11*b* and 7*b*, respectively, and the bottom shaft 10*b* is put through these holes 11*b* and 7*b*, supporting the bearing 11 by the jaw-like bottom portion 7*e* of the development frame 7.

With this arrangement, the tensile strength of the supporting portion of the development frame 7 against the force applied to the supporting portion 72 as the driving force is applied to the development roller 3 is increased by the provision of the pair of supporting pieces 7*d*1 and 7*d*2, i.e., the provision of an additional supporting piece. Further, since the bearing 11 is placed between the pair of supporting pieces 7*d*1 and 7*d*2, it is prevented from being tilted in the axial direction of the development roller 3. Thus, the development roller 3 is prevented from being misplaced downward as the driving force is applied to the development roller 3.

Therefore, the clearance CL1 between the development roller 3 and the peripheral surface of the magnetic sealing member 14 can be kept uniform, being approximately several hundred microns, during image formation, as it is in the first embodiment.

Also, the clearance CL2 between the development roller 3 and the magnetic roller 12 can be kept uniform during image formation.

Miscellaneous Embodiments

The structures for preventing the downward misplacement of the development roller, which are described in the first to fourth embodiments, may be employed in combination as needed. There is no restriction regarding which structures are selected.

In this specification, the sealing member placed at both of the longitudinal ends of the development roller 3 is constituted of the magnetic sealing member 14. However, it may be formed of felt; the effectiveness of the felt based sealing member has been proven. In other words, the material for the sealing member is not limited to the one described in this specification; it may be any material as long as it effectively prevents toner leakage.

As described in the first to fourth embodiments, according to the present invention, the development roller 3 can be kept at the correct position even if the development roller 3 is displaced downward as the driving force is applied to the development roller 3 (first embodiment). Further, the development roller 3 can be prevented from being misplaced downward as driving force is applied to the development roller 3 (second to fourth embodiments). Therefore, the image developing performance does not decrease.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive member; and a developing member for developing a latent image formed on said electrophotographic photosensitive member at a developing position, wherein said developing member is supported on said cartridge frame at a position deviating from the developing position and corresponding to a position to which said developing member is displaced by deflection of said cartridge frame due to rotation of said developing member by a driving force received from the main assembly of said apparatus when said process cartridge is mounted to said main assembly.

2. A process cartridge according to claim 1, wherein said developing member is in the form of a roller which receives the driving force at one longitudinal end, and the position of the developing roller is deviated at the longitudinal end.

3. A process cartridge according to claim 2, wherein said electrophotographic photosensitive member is in the form of a drum which receives the driving force from the main assembly of said apparatus, and wherein said developing receives the driving force from said electrophotographic photosensitive member.

4. A process cartridge according to claim 2, wherein said developing is supported on said cartridge frame by a bearing member.

5. A process cartridge according to claim 4 wherein said bearing member is provided with an upper circular hole and a lower elongated hole for supporting a shaft of said developing roller.

6. A process cartridge according to claim 2, wherein a sealing member for preventing leakage of developer from the cartridge frame, is provided at each of one end and the other longitudinal end of said developing roller with a gap from a peripheral surface of said developing roller, and wherein the gap at an upstream side in a rotational direction of said developing roller, is larger at one end where it receives the driving force than at said other end, and the gap at a downstream side in the rotational direction of said developing roller, is smaller at said one end than at said other end.

7. A process cartridge according to claim 6, wherein said sealing member is a magnetic sealing member, and said sealing member prevents the developer from leaking by magnetic force.

8. A process cartridge according to claim 1, wherein said developing member is supported on said cartridge frame at a position upwardly deviating from the developing position, when said process cartridge is mounted to the main assembly of the apparatus.

9. A process cartridge detachably mountable relative to a main assembly of an electrophotographic image forming apparatus, comprising:

a drum frame;

an electrophotographic photosensitive drum supported in said drum frame;

a drum driving force receiving member, provided at one longitudinal end of said electrophotographic photosensitive drum, for receiving a driving force for rotating said electrophotographic photosensitive drum when said process cartridge is mounted to the main assembly;

a charging member, supported in said drum frame, for charging said electrophotographic photosensitive drum;

a developing frame rotatably coupled with said drum frame;

a developing roller, supported on said developing frame, for developing a latent image formed on said photosensitive drum; and a developing roller driving force receiving member for receiving a driving force from said drum driving force receiving member when said process cartridge is mounted to the main assembly, wherein said developing roller is supported on said developing frame at a position deviating from a developing position and corresponding to a position to which said developing roller is displaced by deflection of said developing frame due to rotation of said developing roller by a driving force received from the developing roller driving force receiving member when said process cartridge is mounted to said main assembly.

10. A process cartridge according to claim 9, wherein said developing roller is supported in said developing frame through a bearing member.

11. A process cartridge according to claim 9, wherein said bearing member is provided with an upper circular hole and a lower elongated hole for supporting a shaft of said developing member.

12. A process cartridge according to claim 9 or 10, further comprising a sealing member, at both longitudinal ends of said developing roller, for preventing leakage of developer from said developing frame with a gap from a circumferential surface of said developing roller, and wherein the gap at an upsteam side in a rotational direction of said developing roller, is larger at one end where it receives the driving force than at the other end, and the gap at a downstream side in the rotational direction of said developing roller, is smaller at said one end than at said other end.

13. A process cartridge according to claim 12, wherein said sealing member is a magnetic sealing member which prevents developer from leaking by magnetic force.

14. A process cartridge according to claim 9, wherein said developing roller is supported on said developing frame at a position upwardly deviating from a developing position, when said process cartridge is mounted to the main assembly of the apparatus.

15. An electrophotographic image forming apparatus for forming an image on a recording material, to which a process cartridge is detachably mountable to a main assembly, comprising:

a. a mounting member for detachably mounting the process cartridge, said process cartridge including:

a cartridge frame;

an electrophotographic photosensitive member; and a developing member for developing a latent image formed on said electrophotographic photosensitive member at a developing position, wherein said developing member is supported on said cartridge frame at a position deviating from the developing position and corresponding to a position to which said developing member is displaced by deflection of said cartridge frame due to rotation of said developing member by a driving force received from the main assembly of said apparatus when said process cartridge is mounted to said main assembly;

b. a feeding member for feeding the recording material; and c. a driving force transmitting member for transmitting the driving force to the process cartridge mounted to said mounting member.

16. An apparatus according to claim 15, wherein said driving force transmitting member transmits the driving force to a driving force receiving member provided at one longitudinal end of said electrophotographic photosensitive member contained in said process cartridge.

17. An electrophotographic image forming apparatus for forming an image on a recording material, to which a process cartridge is detachably mountable to a main assembly, comprising:

a. a mounting member for detachably mounting the process cartridge, said process cartridge including:

a drum frame;

an electrophotographic photosensitive drum supported in said drum frame;

a drum driving force receiving member, provided at one longitudinal end of said electrophotographic photosensitive drum, for receiving a driving force for rotating said electrophotographic photosensitive drum when said process cartridge is mounted to the main assembly;

a charging member, supported on said drum frame, for charging said electrophotographic photosensitive drum;

a developing frame rotatably coupled with said drum frame;

a developing roller, supported in said developing frame, for developing a latent image formed on said electrophotographic photosensitive drum; and a developing roller driving force receiving member for receiving a driving force from said drum driving force receiving member when said process cartridge is mounted to the main assembly, wherein said developing roller is supported on said developing frame at a position deviating from a developing position and corresponding to a position to which said developing roller is displaced by deflection of said cartridge frame due to rotation of said developing roller by a driving force received from the developing roller driving force receiving member when said process cartridge is mounted to said main assembly, b. a feeding member for feeding the recording material; and c. A driving force transmitting the driving force to said drum driving force receiving member when said process cartridge mounted to said mounting member.

18. An apparatus according to claim 17, wherein said driving force transmitting member transmits the driving force to a driving force receiving member provided at one longitudinal end of said electrophotographic photosensitive drum.

* * * * *

UNITED STATES PATENT AND TRADEMARK OFFICE

CERTIFICATE OF CORRECTION

PATENT NO. : 6,101,354
DATED : August 8, 2000
INVENTOR(S) : Takao Nakagawa et al.

It is certified that error appears in the above-identified patent and that said Letters Patent is hereby corrected as shown below:

Title page,
Item [57], ABSTRACT,
Line 3, "member;" should read -- member --.
Line 5, "member;" should read -- member. --.

Column 1,
Line 17, "electrophotographic" should read -- electrophotographic --.
Lien 18, "apparatus" should read -- apparatus" --.
Line 47, "a" should read -- as a --.

Column 13,
Line 35, "developing" should read -- developing roller --.
Line 37, "claim 4" should read -- claim 4, --.

Column 14,
Line 29, "claim 9," should read -- claim 10, --.

Column 15,
Line 29, "on" should read -- in --.

Column 16,
Line 16, "cartridge" should read -- developing --.
Line 23, "cartridge" should read -- cartridge is --.

Signed and Sealed this

Sixteenth Day of April, 2002

*Attest:*

*Attesting Officer*

JAMES E. ROGAN
*Director of the United States Patent and Trademark Office*